US005103534A

United States Patent [19]

Caveney

[11] Patent Number: 5,103,534

[45] Date of Patent: Apr. 14, 1992

[54] SELECTIVELY COATED CABLE TIE

[75] Inventor: Jack E. Caveney, Hinsdale, Ill.

[73] Assignee: Panduit Corp., Tinley Park, Ill.

[21] Appl. No.: 670,674

[22] Filed: Mar. 18, 1991

[51] Int. Cl.[5] ..... B65D 63/00

[52] U.S. Cl. ..... 24/16 PB; 24/20 R; 24/16 R

[58] Field of Search ..... 24/16 PB, 25, 17 AP, 24/20 R, 16 R

[56] References Cited

U.S. PATENT DOCUMENTS

| | | | |
|---|---|---|---|
| 3,445,898 | 5/1969 | Goodrich | 24/16 PB |
| 4,399,592 | 8/1983 | Chopp, Jr. et al. . | |
| 4,441,677 | 4/1984 | Byerly | 24/16 PB X |
| 4,730,615 | 3/1988 | Sutherland et al. | 24/16 PB X |

OTHER PUBLICATIONS

Critchley Limited Advertisement Advertising Critchley Betaties.

*Primary Examiner*—Laurie K. Cranmer

*Attorney, Agent, or Firm*—Charles R. Wentzel; Mark D. Hilliard

[57] ABSTRACT

A selectively coated cable tie is only coated along the lateral edges of the strap of the cable tie leaving an uncoated longitudinally extending medial strip portion of the strap for engagement with a locking mechanism in the head of the tie whereby the selectively coated cable tie provides a cable tie with smooth non-abrasive lateral edges while not significantly degrading the effectiveness of the locking mechanism of the tie.

6 Claims, 1 Drawing Sheet

SELECTIVELY COATED CABLE TIE

The present invention generally relates to coated cable ties for fastening objects in a bundle.

BACKGROUND OF THE INVENTION

Prior metal cable ties have utilized a nylon coating over the entire surface of the cable tie strap to protect objects that come into contact with the tie from abrasion by the sharp edges of the metal tie. Coated metal ties do not require the relatively expensive manufacturing step of forming a smooth radius on the sharp edges of each tie after it is slit from stock, thus decreasing the manufacturing cost of the coated ties.

Coating the entire strap portion of a ball-lock cable tie of the type disclosed in U.S. Pat. No. 4,399,592 significantly degrades the loop tensile strength of the ball-lock tie. Thus, there is a need for a means of coating a metal ball-lock cable tie with nylon to protect the objects to be bundled by the tie from abrasion by the edges of the tie while maintaining the locking effectiveness of the ball-lock cable tie.

SUMMARY OF THE INVENTION

The object of the present invention is the provision of a cable tie having coated lateral edges to protect objects that come into contact with the lateral edges of the tie where the coating does not interfere with the effectiveness of the locking mechanism of the tie.

In general, a selectively coated cable tie includes a strap having coating means for covering the lateral sharp edges of the strap to prevent abrasion of objects that come into contact with the edges of the tie; and a locking head secured to a first end of the strap having locking means for locking a second end of the strap to the head; wherein the coating means does not cover an uncoated longitudinally extending medial portion of the strap which is aligned with the strap locking means in the head and is disposed on a side of the strap that engages the locking means such that the locking means of the strap does not engage the coating means when the second end of the strap is locked within the head of the strap.

DESCRIPTION OF THE PREFERRED EMBODIMENT

Figure 1:
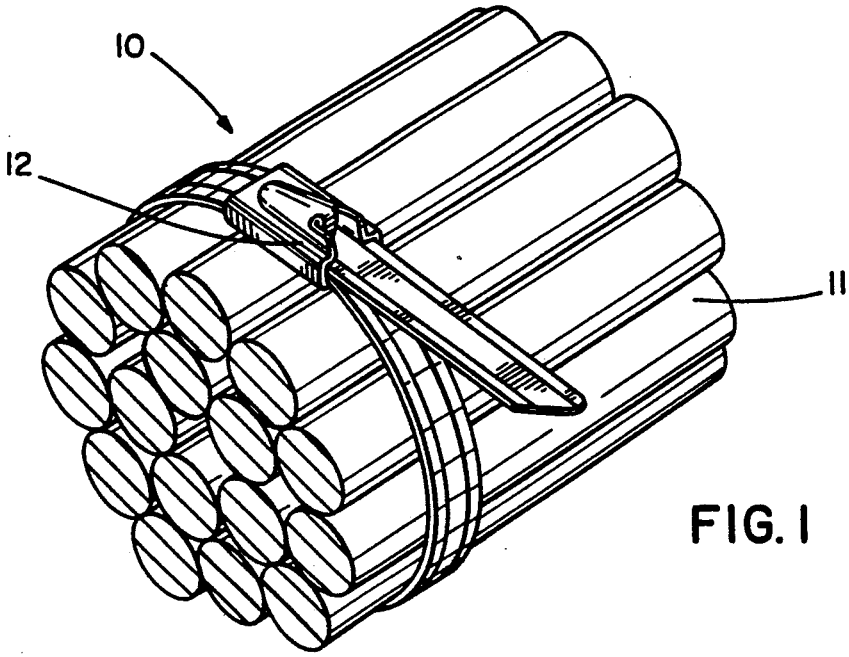
FIG. 1 is an isometric view of a cable tie embodying the concept of the present invention shown secured around a bundle of wires.
Figure 2:
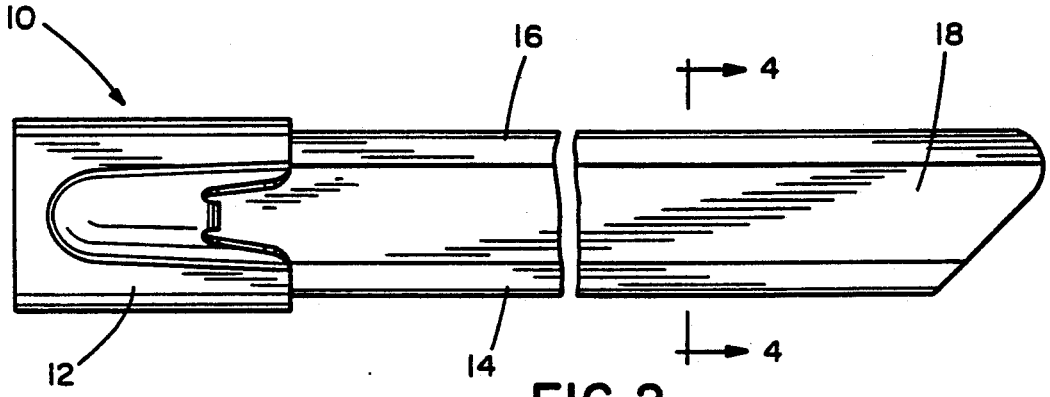
FIG. 2 is a top view of the cable tie of FIG. 1.
Figure 3:
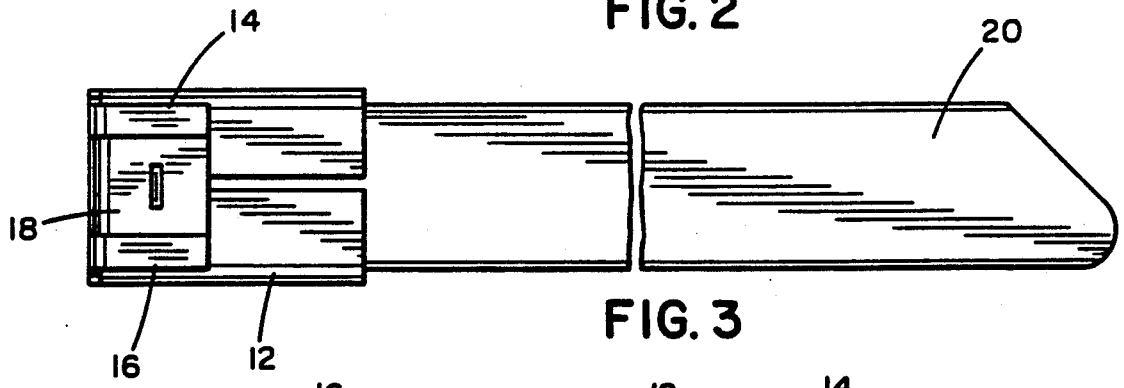
FIG. 3 is a bottom view of the cable tie of FIG. 1.
Figure 4:
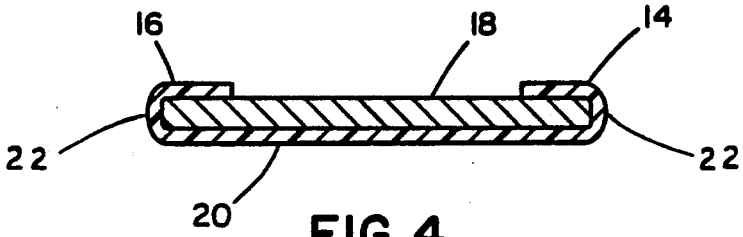
FIG. 4 is a sectional view taken along line 4—4 of FIG. 2.

A selectively coated cable tie embodying the concept of the present invention is designated generally by the numeral !0 in the accompanying drawings. Cable tie 10 includes a locking metal head 12 that includes a locking metal ball (not shown) that locks a metal strap 18 within head 12 to secure wires 11 in a bundle in the manner explained in detail in commonly assigned U.S. Pat. No. 4,399,592 which is incorporated herein by reference. The inside of head 12 and the locking metal ball are preferably not coated.

A continuous 0.003–0.005 inch (0.008–0.013 cm) nylon "11" coating is extruded on the metal strap 18 including a longitudinally extending first top edge portion 14, a longitudinally extending back portion 20 and a second longitudinally extending top edge portion 16 all of which are connected by longitudinally extending lateral edge portions 22. Strap 18 is thus left uncoated along a longitudinally extending medial strip portion that is aligned with the locking mechanism in head 12 and is disposed on the side of strap 18 that engages the locking ball mechanism of head 12 when the distal end of strap 18 is inserted into locking head 12 of tie 10. The nylon coating could also be only applied to cover the lateral edges of strap 18, leaving an uncoated longitudinally extending medial strip portion on each of the opposing planar sides of strap 18. Although nylon "11" is the preferred coating material, the present invention encompasses the use of any coating suitable to cover the sharp lateral edges of strap 18.

Although the present invention is illustrated by the description of the locking ball mechanism of tie 10, the teachings of the present invention can be applied to locking ties having a variety of locking mechanisms, the locking effectiveness of which are degraded by application of a coating to strap 18.

I claim:

1. A selectively coated cable tie, comprising:

a strap having coating means for covering lateral sharp edges of the strap to prevent abrasion of objects that come into contact with the edges of the tie; and a locking head secured to a first end of the strap having locking means for locking a second end of the strap to the head; wherein the coating means does not cover an uncoated longitudinally extending medial portion of the strap which is aligned with the strap locking means in the head and is disposed on a side of the strap that engages the locking means such that the locking means of the strap does not engage the coating means when the second end of the strap is locked within the head of the strap, wherein the coating means covers the entire length of the lateral sharp edges of a portion of the second end of the strap contained within the locking head when the strap is locked within the locking head.

2. A tie as set forth in claim 1, wherein the strap is formed of metal.

3. A tie as set forth in claim 1, wherein the locking means includes a locking ball.

4. A tie as set forth in claim 1, wherein the coating means is a nylon coating.

5. A tie as set forth in claim 1, wherein the coating means covers the entire surface of the strap except for the uncoated longitudinally extending medial portion and the distal ends of the strap.

6. A tie as set forth in claim 1, wherein the coating means only covers lateral edges of the strap.

* * * * *